US007819225B2

(12) United States Patent
Smith

(10) Patent No.: US 7,819,225 B2
(45) Date of Patent: Oct. 26, 2010

(54) ICE LADDER

(76) Inventor: Christopher L. Smith, 1117 N. Cumberland Cir., McHenry, IL (US) 60050

( * ) Notice: Subject to any disclaimer, the term of this patent is extended or adjusted under 35 U.S.C. 154(b) by 595 days.

(21) Appl. No.: 11/841,287

(22) Filed: Aug. 20, 2007

(65) Prior Publication Data

US 2009/0050408 A1 Feb. 26, 2009

(51) Int. Cl.
*E04G 3/00* (2006.01)

(52) U.S. Cl. ..... 182/95; 182/206; 182/97

(58) Field of Classification Search ..... 182/95, 182/228.2, 97, 206, 99, 86, 85, 88, 89; 441/82
See application file for complete search history.

(56) References Cited

U.S. PATENT DOCUMENTS

| | | | | | |
|---|---|---|---|---|---|
| 2,232,414 | A | * | 2/1941 | Swann | 182/206 |
| 3,825,096 | A | | 7/1974 | Mendes | |
| 4,093,257 | A | * | 6/1978 | Tarvin | 280/166 |
| 4,146,941 | A | | 4/1979 | Haslam | |
| 4,164,269 | A | * | 8/1979 | Jackson | 182/229 |
| 4,179,764 | A | * | 12/1979 | Lindblade | 441/82 |
| 4,311,207 | A | * | 1/1982 | Lurry | 182/206 |
| 4,408,680 | A | * | 10/1983 | Ross | 182/68.1 |
| 4,724,925 | A | * | 2/1988 | Ritten | 182/97 |
| 4,968,046 | A | * | 11/1990 | O'Connell et al. | 280/12.11 |
| 5,427,557 | A | * | 6/1995 | Lunden, Sr. | 441/82 |
| 5,549,312 | A | * | 8/1996 | Garvert | 280/166 |
| 5,624,006 | A | * | 4/1997 | Richardson, Jr. | 182/45 |
| 5,807,153 | A | * | 9/1998 | Allen et al. | 441/82 |
| 6,003,633 | A | * | 12/1999 | Rolson | 182/127 |
| 6,116,378 | A | * | 9/2000 | Barrow | 182/127 |
| 6,190,222 | B1 | * | 2/2001 | Senger | 441/82 |
| 6,378,654 | B1 | * | 4/2002 | Ziaylek et al. | 182/97 |
| 6,789,648 | B2 | * | 9/2004 | Cook | 182/86 |
| D498,454 | S | | 11/2004 | Garelick et al. | |
| 6,938,573 | B1 | * | 9/2005 | Garelick | 114/362 |
| 6,991,063 | B2 | | 1/2006 | Latimer et al. | |
| 7,401,798 | B2 | * | 7/2008 | Dolan | 280/163 |
| 2002/0042234 | A1 | * | 4/2002 | Wallasch | 441/80 |
| 2008/0202852 | A1 | * | 8/2008 | Zsido | 182/129 |
| 2009/0050408 | A1 | * | 2/2009 | Smith | 182/228.2 |

FOREIGN PATENT DOCUMENTS

DE 101 08 534 A1 9/2002

* cited by examiner

*Primary Examiner*—Katherine W Mitchell
*Assistant Examiner*—Candace L Bradford
(74) *Attorney, Agent, or Firm*—Mathew R. P. Perrone, Jr.; Bric A. Crawford

(57) ABSTRACT

An ice ladder has a climbing ladder mounted to an adjustable frame, with the adjustable frame including a securing apparatus mounting on a desired surface, especially an opening in an ice covered body of water. The ice ladder has an adjustable frame or member, a locking bar, and a climbing ladder releasably secured to the locking bar. The adjustable member is secured to the locking bar.

14 Claims, 9 Drawing Sheets

ICE LADDER

This invention relates to an ice ladder and more particularly to a portable ice ladder for use as a rescue or recreational device.

BACKGROUND OF THE INVENTION

In a Northern climate, it is quite common for ice to form on a body of water, such as a lake or a river. Such ice-covered bodies of water provide many recreational opportunities as well as business opportunities. There can be people ice skating, playing ice hockey, ice boat sailing, riding a snow mobile and similar activities.

During the course of the activity, accidents can occur. The more serious accidents involve a person breaking through the ice. Then, a rescue operation is added to the recreational and business opportunities. Such a rescue operation usually requires entering and leaving water from ice. This procedure is extremely dangerous.

For a person to effectively operate under the ice on a body of water, a self-contained underwater breathing apparatus is required, so that a person can submerge under the water, for either a rescue purpose or a recreational purpose. Such an apparatus is commonly known by its acronym of SCUBA gear. The very nature of SCUBA gear requires that it be heavy. When the weight of the gear is added to the weight of the person wearing the gear, entering or leaving a body of water, which is at least partially covered by ice, becomes very difficult.

A current method to leave the body of partially covered by ice involves removal of the SCUBA gear, while in the water. This method is very time-consuming and greatly extends the time in the water. It is very desirable to keep the time in water covered at least partly by ice to a minimum. Removing the scuba gear while in the water thus can cause problems, for both the gear and the diver.

To exit the body of water covered at least partly by ice requires at least one, and preferably three people to assist the SCUBA diver. Having even one person close to the edge of the ice on a body of water can be dangerous, especially if the ice breaks. Furthermore, the person helping the diver wearing SCUBA gear is usually required to drag that diver across the ice to safety. During the dragging procedure, the expensive SCUBA gear is very likely to be damaged. It is clearly desirable to minimize such damage to such expensive gear.

There is also a danger to the support people helping the diver. There is a major issue with regard to anyone standing on the edge of the ice to lift the person. The current method usually involves one to three people. Usually two of them stand at the edge of the ice. They have to bend down and reach the diver while standing on a slippery surface, which is clearly dangerous. Thus, the safety and physical welling being of the support staff as well as the diver is very critical.

Some of these problems clearly occur with other flat surfaces other than ice. Whether this flat surface is a pier, a boat deck, or similar surface, access can be a problem. Access is especially a problem for a raised flat surface. If such access to these surfaces can also be simplified, great advantages are obtained.

Clearly, it is desirable to facilitate entry and leaving of an ice-covered body or to have access to a flat surface. The device, which makes this possible, must be easily managed and transported. It also must be strong enough to carry out the function without increasing the danger of breaking ice.

SUMMARY OF THE INVENTION

Among the many objectives of the present invention is the provision of an ice ladder, which is easily positioned on the ice covering a body of water.

Another objective of the present invention is the provision of an ice ladder, which is easily positioned in an opening in the ice covering a body of water.

Yet another objective of the present invention is the provision of an ice ladder, which is easily removed from an opening in the ice covering a body of water.

Still another objective of the present invention is the provision of an ice ladder, which is easily accessible by a person leaving a body of water at least partially covered by ice.

Also an objective of the present invention is the provision of an ice ladder, which is easily accessible by a person entering a body of water at least partially covered by ice.

A further objective of the present invention is the provision of an ice ladder, which is easily accessible by a person wearing SCUBA gear and leaving a body of water at least partially covered by ice.

Yet a further objective of the present invention is the provision of an ice ladder, which is easily accessible by a person wearing SCUBA gear and entering a body of water at least partially covered by ice.

A still further objective of the present invention is to minimize damage to the SCUBA gear.

Another objective of the present invention is the provision of an ice ladder, which is easily positioned in order to access a flat surface.

Yet another objective of the present invention is the provision of an ice ladder, which is easily positioned in order to access a raised, flat surface.

Still another objective of the present invention is the provision of an ice ladder, which decreases the risk to support personnel.

A further objective of the present invention is the provision of an ice ladder which is securely attached to the ice.

A still further objective of the present invention is the provision of an ice ladder, which decreases the risk to the diver.

These and other objectives of the invention (which other objectives become clear by consideration of the specification, claims and drawings as a whole) are met by providing an ice ladder with a climbing ladder mounted to an adjustable frame, with the adjustable frame including a securing apparatus mounting on a desired surface.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
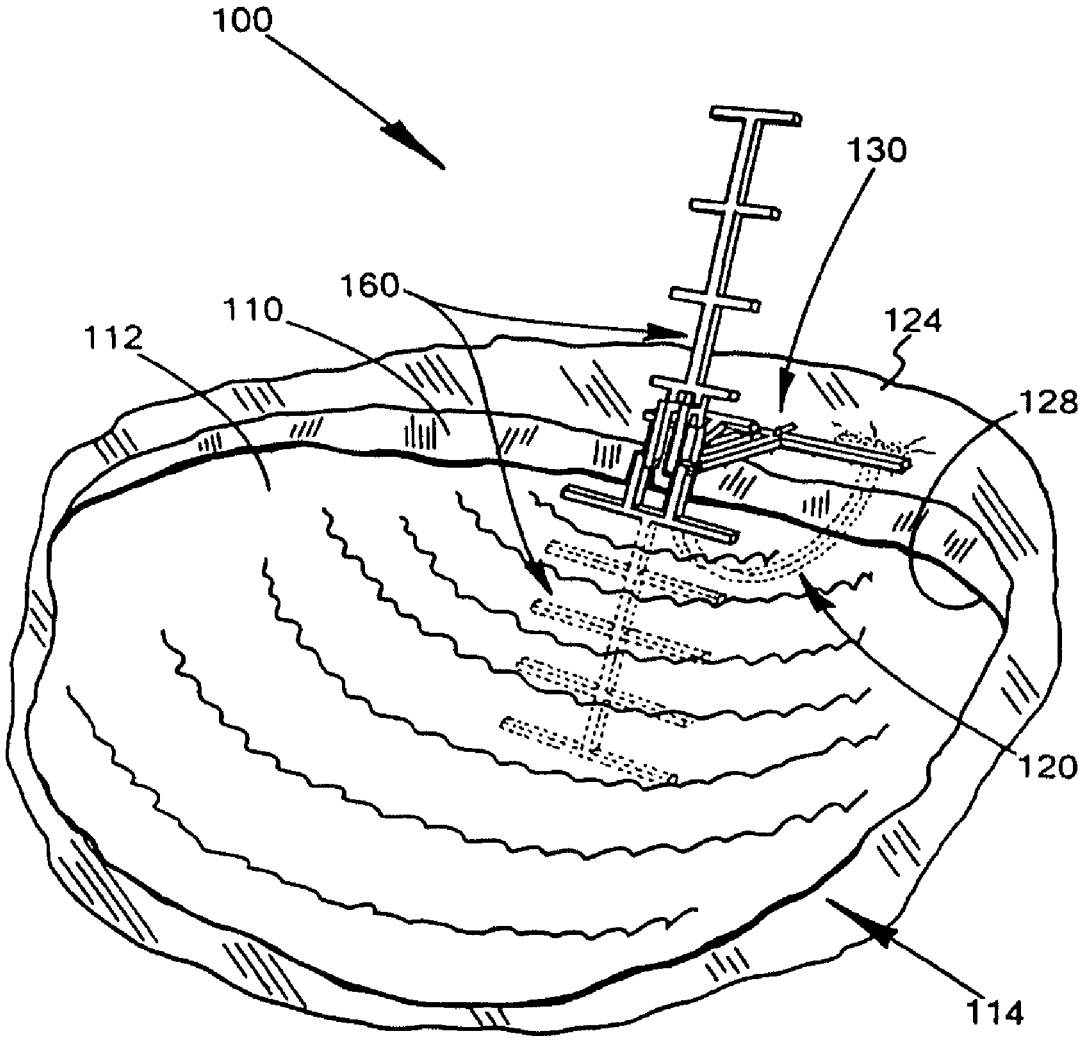
FIG. 1 depicts a perspective view of the ice ladder of this invention 100 in use on a body of water 112 covered partially with ice 110.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

The ice ladder of this invention has an adjustable frame or member, a locking bar, and a climbing ladder releasably secured to the locking bar. The adjustable member is secured to the locking bar. Then, this combination is mounted on the ice through an opening therein, or appropriate, substantially flat surface. At an under ice end of the adjustable member, is a locking spike. The climbing ladder is positioned through a locking assembly on the locking bar.

The locking bar has an aperture, which receives or allows the adjustable member to slide therethrough; and a locking assembly, which allows the climbing ladder to be attached perpendicularly to the locking bar. Optionally, but preferably, spikes are situated on the underside of the locking bar, in order to penetrate the ice and assist with the securing of the ice ladder. In use, the locking bar is positioned on top of the ice. Then the adjustable member slides into the locking bar through the aperture. The locking spike, on the adjustable member, is then secured under the ice.

The climbing ladder is secured on the locking bar through the interaction of its coupling bars and the angled receiving tubes found on the locking bar. The climbing ladder is then unfolded into the water. As weight is put on the ladder, a lever action locks the adjustable member in place, especially with the weight of a person on the ladder. As more weight is applied to the ladder, the lever action forces the locking spike of the adjustable member to lock more securely into the ice. As a person moves down the ladder into the water, the ladder is in the water. As the person exits the water, the ladder rotates onto the top of the ice and permits the diver to crawl or otherwise safely move to place of safety, in spite of the heavy SCUBA gear being worn.

In a preferred form, the adjustable member is about 0.9 meter to about 1.1 meters in diameter, is made of stainless steel. Because the ice ladder is easily separated into the two pieces, it may be carried separately and easily to and from a desired site. The foldable ladder is made of similar material with each portion of the ice ladder weighing about 25 to 35 kilograms. The ice on which the ice ladder is used is preferably at least five centimeters thick. With the adjustable member described herein, the ice ladder may be used on ice up to 60 centimeters thick. At greater ice thicknesses, the adjustable member and the locking member must be larger.

An optional safety device for securing the adjustable member to the ice involves a locking mechanism on the arc which may be a hand screw. The hand screw works with the aperture to apply pressure to the adjustable member which causes the locking spike to push up tight against the bottom of the ice.

After setting the cross bar, an ice screw can be added to the structure to further secure the cross bar into the ice. However, this is not necessary in all cases. While the ice screw provides an additional safety function, it is optional.

Referring now to FIG. 1, ice ladder 100 is positioned for use on ice 110 covering a body of water 112, through an opening 114 in the ice 110. Ice ladder 100 has three components: adjustable member 120, locking bar 130, and climbing ladder 160.

Figure 2:
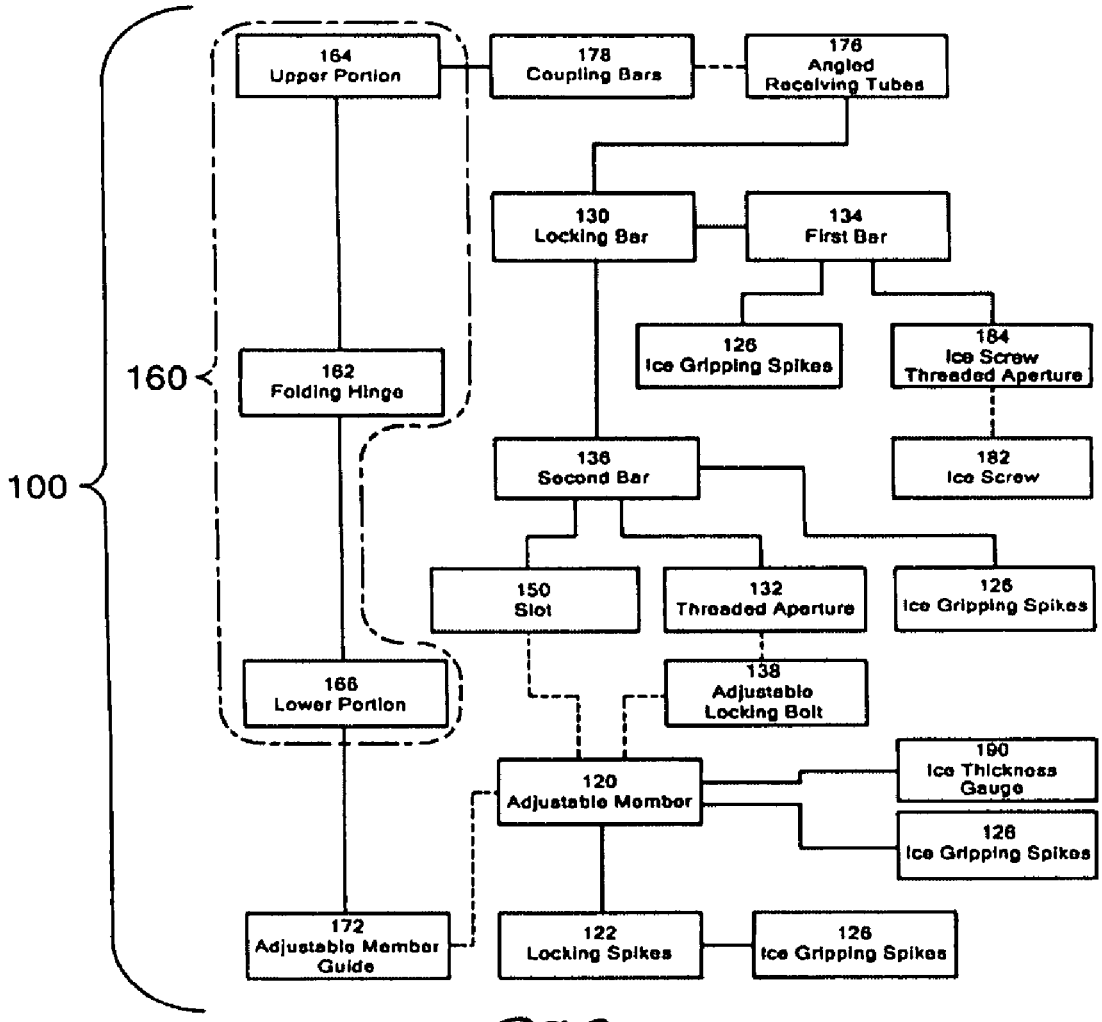
FIG. 2 depicts a block diagram of the ice ladder 100 of this invention.

Now considering FIG. 2, locking bar 130 is formed by the cooperation of with first bar 134 and second bar 136. First bar 134 receives second bar 136, preferably at a central portion thereof. Second bar 136 includes ice gripping spikes 126 as a securing device and support ladder 100 in a desired position.

Figure 3:
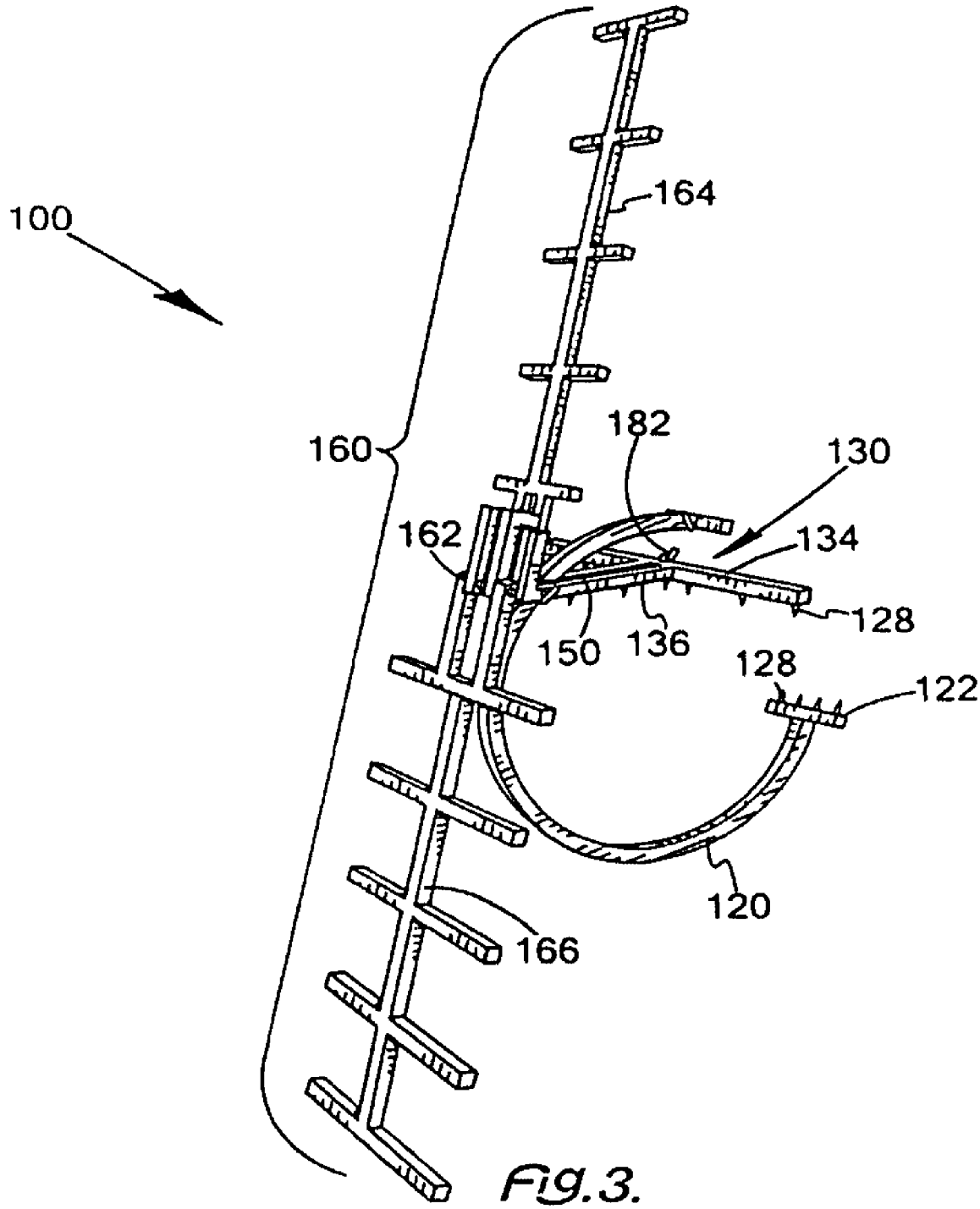
FIG. 3 depicts a top, perspective view of the ice ladder 100 of this invention.
Figure 4:
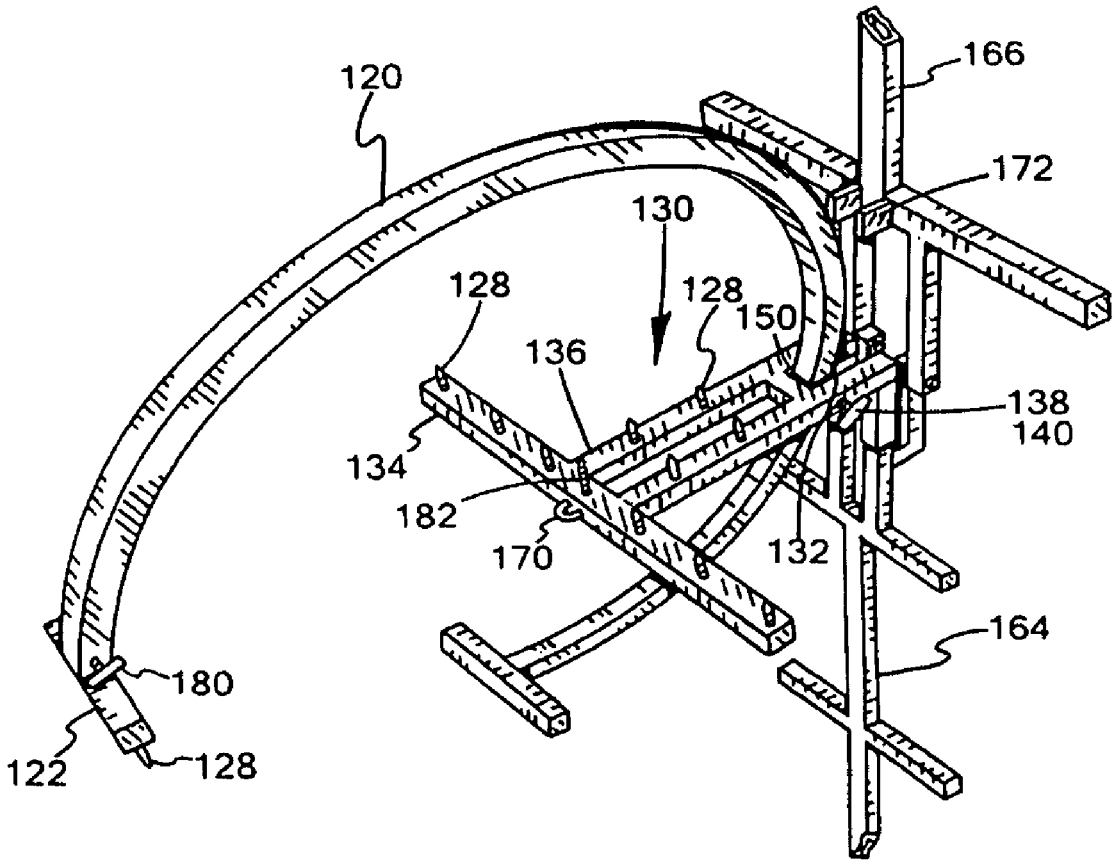
FIG. 4 depicts a bottom, perspective view of the ice ladder 100 of this invention, based on FIG. 3.
Figure 5:
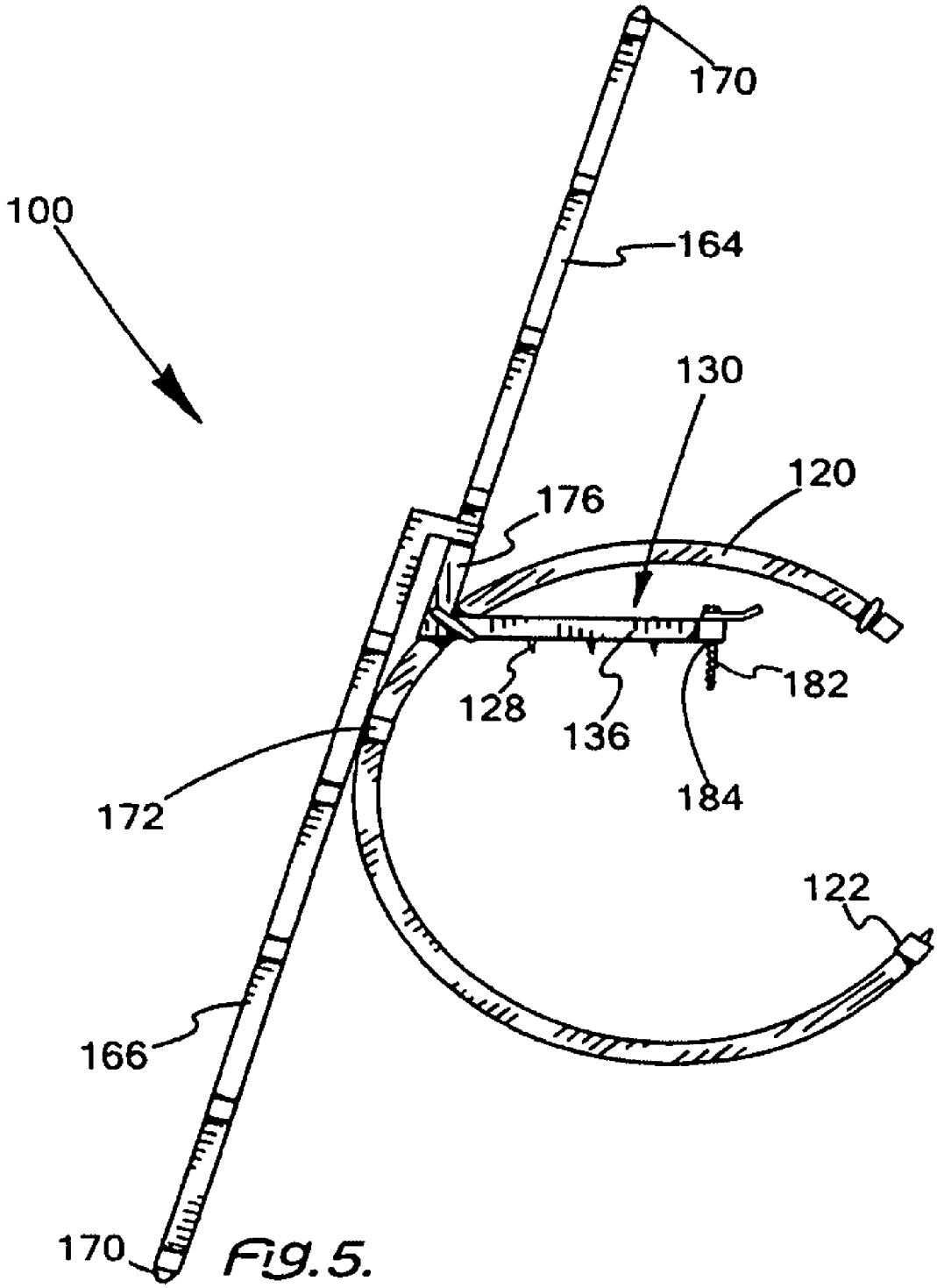
FIG. 5 depicts a side view of the ice ladder 100 of this invention.

Adding FIG. 3, FIG. 4, and FIG. 5, to the consideration, locking bar 130 has first bar 134 and second bar 136. First bar 134 is perpendicular to second bar 136. Second bar 136 intersects in the center of first bar 134. Locking bar 130 has first bar 134 and a second bar 136 which have ice gripping spikes 128. More particularly, locking bar 130 is secured to the upper surface 124 (FIG. 1) of the ice 110 by ice griping spikes 126 (FIG. 1). Thus, ice gripping spikes 128 add more strength and stability to the attachment of the ice ladder 100 in a desired position.

First bar 134 has an optional ice screw aperture 184 through which ice screw 182 is connected with first bar 134. Ice screw 182 further secures the connection between ice ladder 100 and the ice 110. In addition, second bar 136 has an aperture 132 which cooperates with adjustable member 120. Adjustable member 120 slides through aperture 132 which securely connects it to locking bar 130. Second bar 136 also has hand screw aperture 140 through which hand screw 138 inserts. Hand screw 138 can be tightened in order to securely hold adjustable member 120 in aperture 132. Second bar 136 also has angled receiving tubes 176 which attach locking bar 130 to climbing ladder 160.

Figure 9:
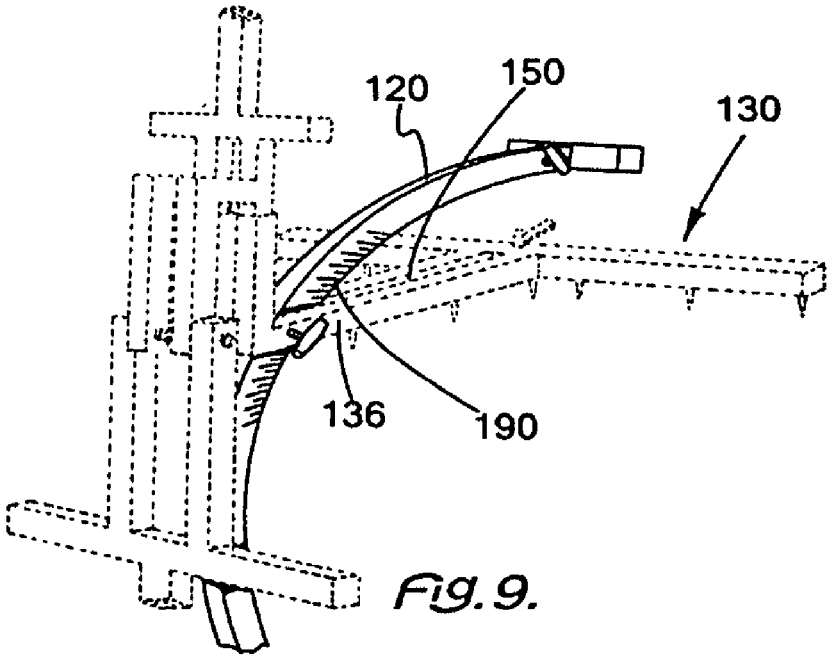
FIG. 9 depicts a perspective view of adjustable member 120 with ice gage 190 thereon for ice ladder 100 of this invention

Adjustable member 120 slides through aperture 132 on locking bar 130. Adjustable member 120 fits through the opening 114 and attaches to under ice 126 with ice gripping spikes 128. Adjustable member 120 may have an optional ice thickness gauge 190 to measure the thickness of ice 110 (FIG. 9).

In one embodiment, adjustable member 120 has spike bar 122 which drives into ice 110 at the lower end to form a secure and stable connection. In an alternative embodiment, adjustable member 120 has ice gripping spikes 128 at the lower end to form a secure and stable connection.

Then, the climbing ladder 160 is mounted on the secured locking bar 130. Climbing ladder 160 has coupling bars 178 (FIG. 6) which cooperate with angled receiving tubes 176 to attach climbing ladder 160 to locking bar 130. Climbing ladder 160 also has adjustable member guide 172 which support and guide adjustable member 120 to increase the stability of its connection with locking bar 130.

Climbing ladder 160 has a folding hinge 162, which is manually activated to extend climbing ladder 160 its full length into the water 112. The upper portion 164 remains above the water surface while the lower portion 166 extends down into the water 112.

Figure 6:
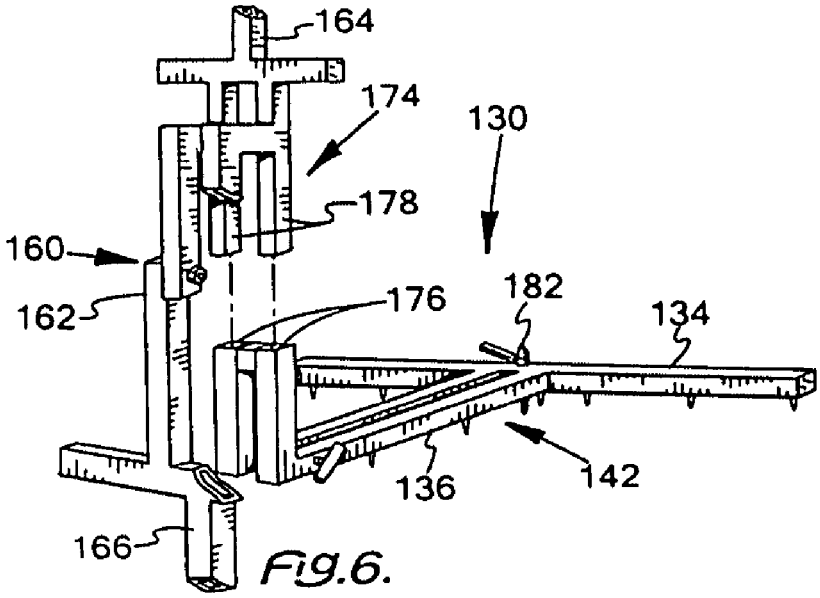
FIG. 6 depicts an exploded perspective view of locking assembly 142 for ice ladder 100 of this invention.
Figure 7:
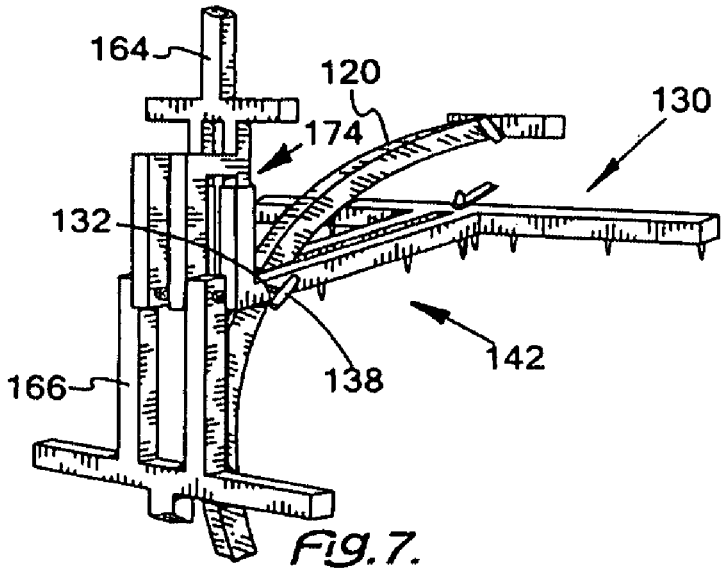
FIG. 7 depicts a perspective view of locking assembly 142 for ice ladder 100 of this invention.

Now adding FIG. 6 and FIG. 7 to the consideration, the structure of locking assembly 142 can be more clearly seen. Locking assembly 142 has angled receiving tubes 176 which are connected to locking bar 130 and coupling bars 178 which are connected to climbing ladder 160. Coupling bars 178 slide into angled receiving tubes 176 and securely connect the climbing ladder 160 to the locking bar 130.

Figure 8:
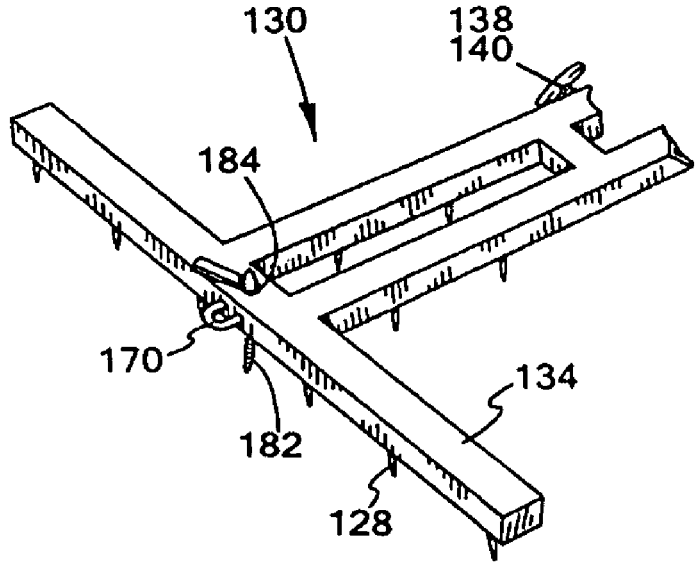
FIG. 8 depicts a perspective view of ice ladder 100 of this invention with the optional ice screw 182 and hand screw 180.

Further adding FIG. 7 and FIG. 8 to the consideration, three optional, but preferred, embodiments the ice ladder 100 can be seen. First, second bar 136 may have a hand screw 138 which is inserted through hand screw aperture 140. Hand screw 138 is tightened against the adjustable member 120 to keep it in the secured position. The use of hand screw 180 aids in stabilizing spike bar 122 or ice gripping spikes 128 further into the ice 110 and forms a more secure and stable connection.

Another optional, but preferred, embodiment of ice ladder 100 includes an ice screw 182 (FIG. 7). First bar 134 has ice screw aperture 184 through which ice screw 182 may be mounted (FIG. 7). Ice screw 182 strengthens and steadies the attachment between the locking bar 130 and the ice 110. Since this connection is more secure, ice gripping spikes 128 form a more secure and stable connection with the ice 110. As a result, ice screw 182 strengthens and stabilizes the overall connection of ice ladder 100 to the ice 110.

Finally, first bar 134 may have an optional retrieving eyelet 170, thereon. A rope or other similar item may be threaded through retrieving eyelet 170 on either end of climbing ladder 160 in order to aid in retrieving ice ladder 100 from water 112. In the same manner climbing ladder 160 may a retrieving eyelet 170 (FIG. 5) on either end thereof, to aid in retrieving ice ladder 100 climbing ladder 160 from water 112.

In FIG. 9, ice gage 190 is added to adjustable member 120. With ice thickness gage 190 thereon, as the adjustable member 120 is inserted into the water and secured in position, the thickness of ice 110 can be easily determined. Such a structure, with this determination, adds to the ability to determine the safety of ice 110 and its thickness. Ice thickness gage 190 may be read at surface 150 from second bar 136 of locking bar 130.

Figure 10:
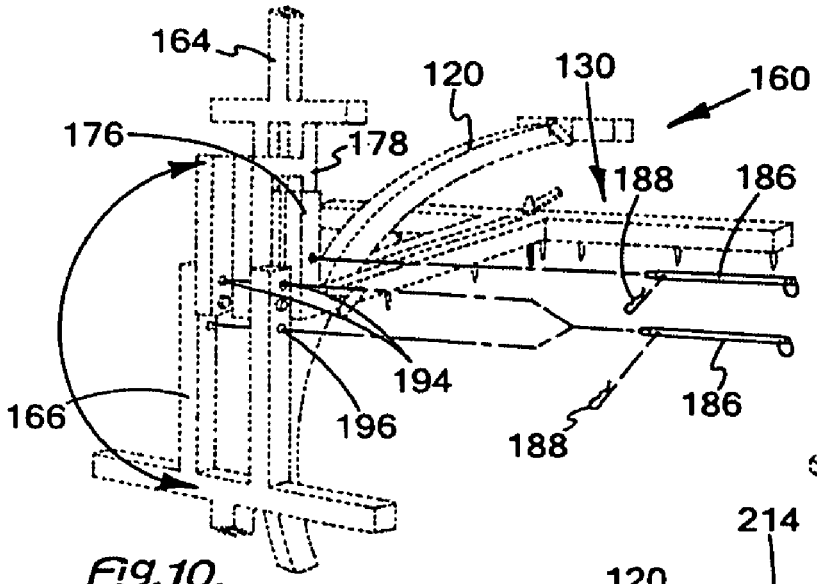
FIG. 10 depicts a perspective view of ice ladder 100 of this invention in phantom in order to show the function of locking pin 186.

With FIG. 10, the folding of climbing ladder 160 becomes more clear. Lower portion 166 folds over upper portion 164. If desired each of lower portion 166 and upper portion 164 has two pair of apertures, an alignable folding pair 194 and alignable straight pair 196. As the straight pairs 196 line up, locking pin 186 is inserted therethrough and held therein with pin clip 188. Then climbing ladder 160 is free to use. As alignable folding pairs are aligned, locking pin 186 is inserted therethrough and held therein with pin clip 188. Then climbing ladder 160 is easier to carry because it is secured in a folded fashion. However, the pins 186 are not required when climbing ladder 160 is in use.

Figure 11:
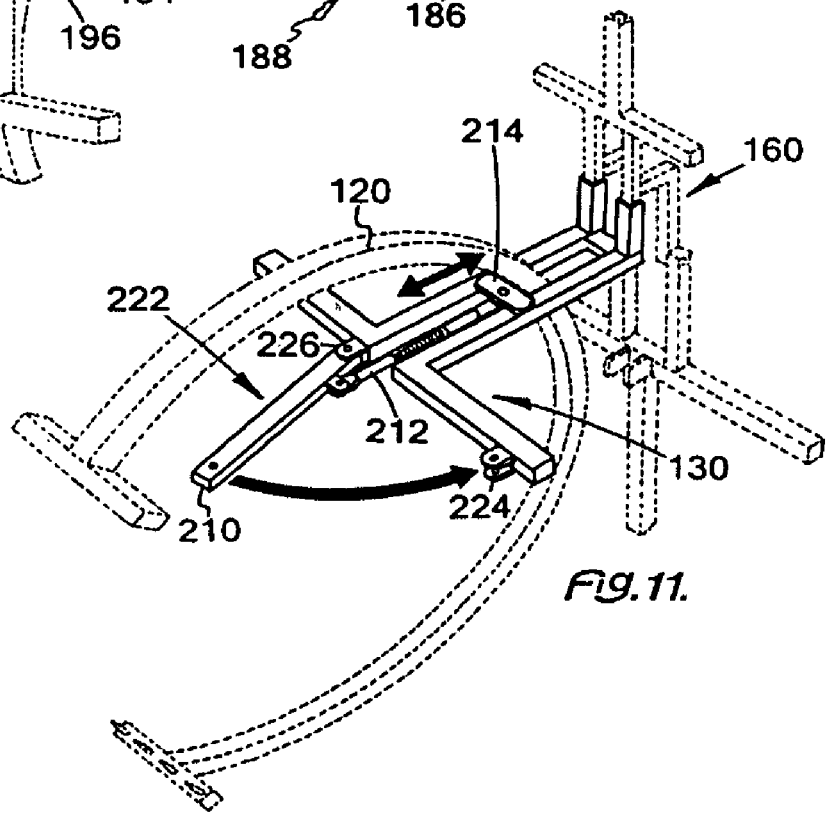
FIG. 11 depicts a top, perspective view of the ice ladder 100 of this invention with the load position 222 of climbing ladder 160 onto adjustable member 120 with pivot arm 210.
Figure 12:
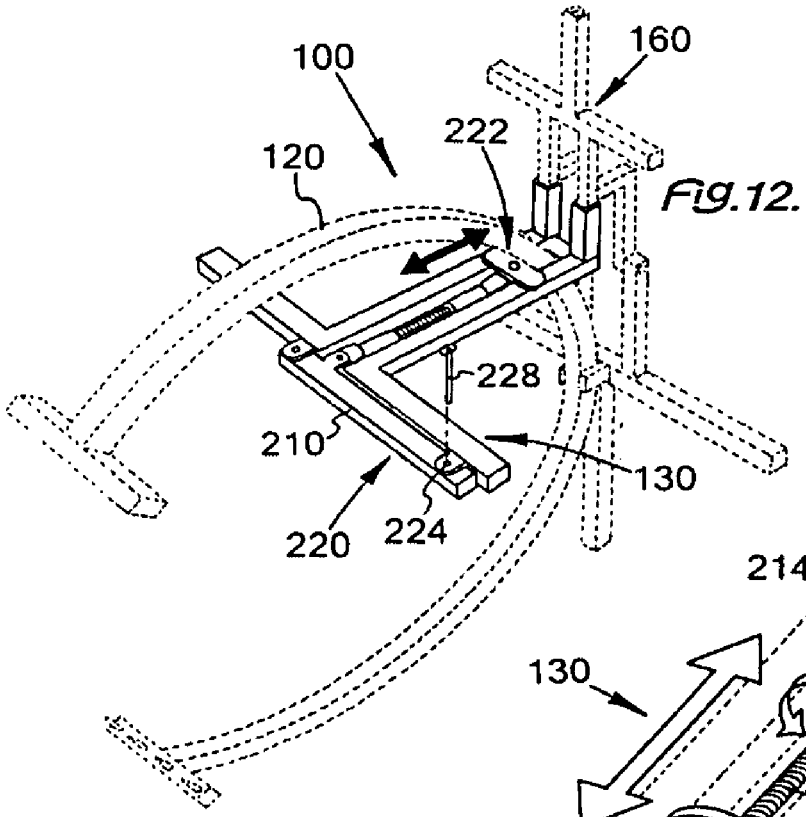
FIG. 12 depicts a top, perspective view of the ice ladder 100 of this invention with the locking position 220 of climbing ladder 160 onto adjustable member 120 with pivot arm 210.

Turning now to FIG. 11 and FIG. 12, the locking of climbing ladder 160 onto adjustable member 120 can be enhanced by securing a pivot arm 210 at one end with a hinge lock 226 to locking bar 130. Locking position 220 (FIG. 12) shows climbing ladder 160 secured to adjustable member 120 with pivot arm 210. Then FIG. 11 shows the ice ladder 100 with the load position 222 so that climbing ladder 160 may be placed onto or removed from adjustable member 120 with pivot arm 210 raised away from locking bar 130. Pivot arm 210 greatly facilitates such action.

FIG. 11 and FIG. 12 combine to show the movement of adjustable moving rod 212 as it is attached to pivot arm 210 at one end. At the other end of adjustable moving rod 212 is flexible member 214. With pivot arm 210 in locking position 222, pivot arm 210 may be secured to locking arm 130 with release member 224, to reinforce locking position 220. As release member 224 separates from pivot arm 210, pivot arm 210 rotates about hinge lock 226 and releases flexible member 214, in order to facilitate, mounting or removing of climbing ladder 160.

Figure 13:
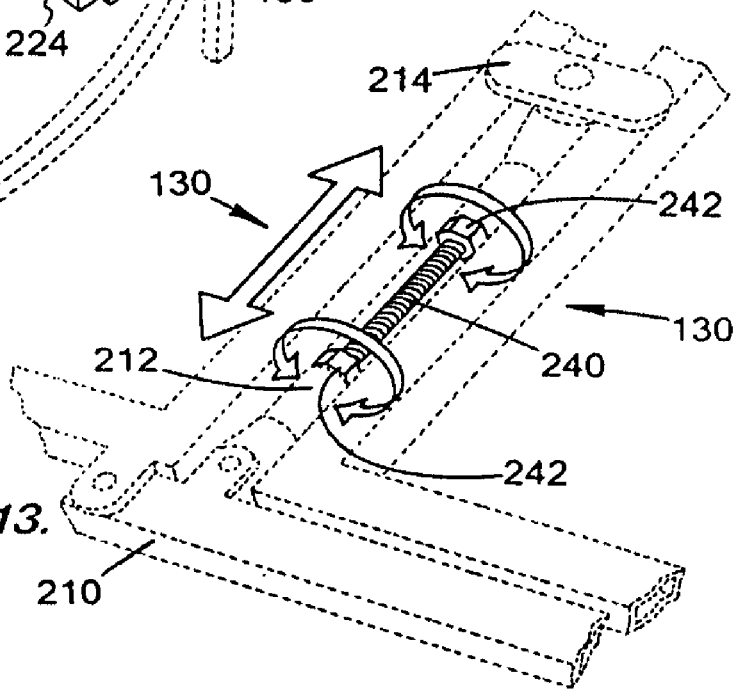
FIG. 13 depicts a top, perspective view of the threaded shaft 240 for locking bar 130 of ice ladder 100 of this invention.

Further considering FIG. 13, the adjustment of locking bar 130 becomes operational. Adjustable moving rod 212 has a threaded shaft 240 between pivot arm 210 and flexible member 214. Mounted on threaded shaft 240 are a pair of adjusting nuts 242, one being near pivot arm 210 and the other being nearer flexible member 214 of locking bar 130. Rotating of one or both of adjusting nuts 242, shortens or lengthens adjustable moving 212 as desired. In this fashion, climbing ladder 160 may have an adjustment to its locking assembly 142 (FIG. 6).

In this fashion ice ladder 100 combines locking bar 130 and climbing ladder 160 to achieve the desired results. Various other features combine to make ice ladder 100 an extremely valuable device for improving a rescue from a partially ice covered body of water 112 (FIG. 1).

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. An ice ladder for facilitating an entry into or an exit from an ice covered body of water comprising:

a) the ice ladder having a climbing ladder mounted on an adjustable frame;

b) the adjustable frame including a securing apparatus to hold the climbing ladder in position;

c) the securing apparatus including an adjustable member and a locking bar;

d) the adjustable member being secured to the locking bar;

e) the locking bar receiving the climbing ladder;

f) the locking bar having a bar aperture to receive the adjustable member in a slidable fashion;

g) a locking assembly securing the climbing ladder to the locking bar;

h) the locking bar including at least one spike situated on an underside of the locking bar in order to penetrate the ice;

i) the adjustable member having at least one locking spike, on the adjustable member securable under the ice;

i) the locking bar having at least one coupling bar and at least one angled receiving tube to receive the climbing ladder;

k) a locking mechanism on the adjustable member securing the adjustable member to a desired position;

l) the climbing ladder being mounted on the at least one angled receiving tube;

m) the locking bar including a first bar and a second bar;

n) the first bar being perpendicular to the second bar at a center of the first bar; and o) the first bar and the second bar having the at least one ice gripping spike for positioning the locking bar on ice.

2. The ice ladder of claim 1 further comprising:

a) the first bar having an ice screw aperture;

b) an ice screw being movably connected with the first bar through the ice screw aperture in order to further secure the ice ladder in position; and c) the second bar having a second bar aperture cooperating with the adjustable member.

3. The ice ladder of claim 2 further comprising:

a) the climbing ladder being mounted on the secured locking bar;

b) the climbing ladder having coupling bars; and c) the coupling bars cooperating with the angled receiving tubes to attach the climbing ladder to the locking bar.

4. The ice ladder of claim 3 further comprising:

a) the climbing ladder having an adjustable member guide in order to stabilize the ice ladder;

b) the climbing ladder having a folding hinge connecting an upper portion to a lower portion in order to extend the climbing ladder its full length;

c) the upper portion being adapted to remain above the water surface; and d) the lower portion being adapted to remain below the water surface.

5. The ice ladder of claim 4 further comprising:

a) the locking assembly having angled receiving tubes connected to a locking bar;

b) the locking assembly having coupling bars connected to the climbing ladder; and c) the coupling bars sliding into the angled receiving tubes in order to securely connect the climbing ladder to the locking bar.

6. The ice ladder of claim 5 further comprising:

a) the second bar having a hand screw inserted through the second bar aperture;

b) the hand screw being tightenable against the adjustable member in order to keep the adjustable in a secured position; and c) the use hand screw being adapted to drives a locking spike or ice gripping spikes further into an ice surface in order to form a more secure and stable connection.

7. The ice ladder of claim 4 further comprising:

a) an ice screw being mounted on the first bar in ans ice screw aperture in order to strengthen and steady an attachment between the locking bar and the ice surface;

b) a retrieving eyelet being mounted on the first bar; and c) an ice gage being on the adjustable member.

8. The ice ladder of claim 7 further comprising:

a) a rope being mounted through the retrieving eyelet for retrieval of the ice ladder; and b) the ice gage determining an ice thickness.

9. The ice ladder of claim 4 further comprising:

a) the climbing ladder providing for the lower portion to fold over the upper portion;

b) the lower portion and the upper portion each having a first pair of apertures and a second pair of apertures;

c) the first pair of apertures being an alignable folding pair;

d) the second pair of apertures being an alignable straight pair;

e) the alignable straight pair being adapted to line up in order to receive a locking pin and to be held therein with a pin clip for use of the climbing ladder;

f) the alignable folding pairs being adapted to line up in order to receive a locking pin and to be held therein with a pin clip for carrying of the climbing ladder;

g) a pivot arm being secured with a hinge lock to the locking bar;

h) the pivot arm having a locking position and an raised position;

i) the locking position holding the climbing ladder secured to the adjustable member with the pivot arm;

j) the raised position permitting removal of the climbing ladder; and k) an adjustable moving being attached to the pivot arm.

10. An ice ladder for facilitating an entry into or an exit from an ice covered body of water comprising:

a) the ice ladder having a climbing ladder mounted on an adjustable frame;

b) the adjustable frame including a securing apparatus to hold the climbing ladder in position;

c) the securing apparatus including an adjustable member and a locking bar;

d) the adjustable member being secured to the locking bar;

e) the locking bar receiving the climbing ladder;

f) the locking bar having a bar aperture to receive the adjustable member in a slidable fashion;

g) a locking assembly securing the climbing ladder to the locking bar for use;

h) the locking bar including at least one spike situated on an underside of the locking bar in order to penetrate the ice;

i) the adjustable member having at least one locking spike, on the adjustable member securable under the ice;

j) the locking bar having at least one coupling bar and at least one angled receiving tube to receive the climbing ladder;

k) a locking mechanism on the adjustable member securing the adjustable member to a desired position;

l) the climbing ladder being mounted on the at least one angled receiving tube;

m) the locking bar including a first bar and a second bar;

n) the first bar being perpendicular to the second bar at a center of the first bar;

o) the first bar and the second bar having the at least one ice gripping spike for positioning the locking bar on ice;

p) the first bar having an ice screw aperture;

q) an ice screw being movably connected with the first bar through the ice screw aperture in order to further secure the ice ladder in position; and r) the second bar having a second bar aperture cooperating with the adjustable member.

11. The ice ladder of claim 10 further comprising:

a) the climbing ladder being mounted on the secured locking bar;

b) the climbing ladder having coupling bars;

c) the coupling bars cooperating with the angled receiving tubes to attach the climbing ladder to the locking bar;

d) the climbing ladder having an adjustable member guide in order to stabilize the ice ladder;

e) the climbing ladder having a folding hinge connecting an upper portion to a lower portion in order to extend the climbing ladder its full length;

f) the upper portion being adapted to remain above the water surface; and g) the lower portion being adapted to remain below the water surface.

12. The ice ladder of claim 11 further comprising;

a) the locking assembly having angled receiving tubes connected to a locking bar;

b) the locking assembly having coupling bars connected to the climbing ladder;

c) the coupling bars sliding into the angled receiving tubes in order to securely connect the climbing ladder to the locking bar;

d) the second bar having a hand screw inserted through the second bar aperture;

e) the hand screw being tightenable against the adjustable member in order to keep the adjustable in a secured position; and f) the use hand screw being adapted to drives a locking spike or ice gripping spikes further into an ice surface in order to form a more secure and stable connection.

13. The ice ladder of claim 11 further comprising:

a) an ice screw being mounted on the first bar in ans ice screw aperture in order to strengthen and steady an attachment between the locking bar and the ice surface;

b) a retrieving eyelet being mounted on the first bar;

c) an ice gage being on the adjustable member;

d) a rope being mounted through the retrieving eyelet for retrieval of the ice ladder; and e) the ice gage determining an ice thickness.

14. The ice ladder of claim 11 further comprising:

a) the climbing ladder providing for the lower portion to fold over the upper portion;

b) the lower portion and the upper portion each having a first pair of apertures and a second pair of apertures;

c) the first pair of apertures being an alignable folding pair;

d) the second pair of apertures being an alignable straight pair;

e) the alignable straight pair being adapted to line up in order to receive a locking pin and to be held therein with a pin clip for use of the climbing ladder;

f) the alignable folding pairs being adapted to line up in order to receive a locking pin and to be held therein with a pin clip for carrying of the climbing ladder;

g) a pivot arm being secured with a hinge lock to the locking bar;

h) the pivot arm having a locking position and an raised position;

i) the locking position holding the climbing ladder secured to the adjustable member with the pivot arm;

j) the raised position permitting removal of the climbing ladder; and k) an adjustable moving being attached to the pivot arm.

* * * * *